United States Patent [19]

Michel

[11] 4,426,084

[45] Jan. 17, 1984

[54] TRUCKING SIMULATION GAME

[76] Inventor: Benjamin F. Michel, P.O. Box 309 Fordham Station, Bronx, N.Y. 10458

[21] Appl. No.: 292,254

[22] Filed: Aug. 12, 1981

[51] Int. Cl.[3] ..... A63F 3/00

[52] U.S. Cl. ..... 273/254; 273/256

[58] Field of Search ..... 273/256, 254, 250, 251, 273/252, 253, 249

[56] References Cited

U.S. PATENT DOCUMENTS

| | | | |
|---|---|---|---|
| 1,329,812 | 2/1920 | Stoll | 273/254 |
| 1,574,394 | 2/1926 | Holme | 273/252 |
| 3,223,420 | 12/1965 | Turner | 273/256 X |
| 3,656,757 | 4/1972 | Carroll | 273/256 X |
| 3,874,671 | 4/1975 | Smith | 273/256 X |
| 3,994,499 | 11/1976 | Breslow | 273/256 |
| 4,032,154 | 6/1977 | Magiera | 273/256 |
| 4,201,388 | 5/1980 | Cantelon | 273/251 |

FOREIGN PATENT DOCUMENTS

| | | | |
|---|---|---|---|
| 2330420 | 6/1977 | France | 273/256 |
| 1386097 | 3/1975 | United Kingdom | 273/252 |
| 2021423 | 12/1979 | United Kingdom | 273/256 |
| 2078118 | 1/1982 | United Kingdom | 273/256 |

*Primary Examiner*—Richard C. Pinkham
*Assistant Examiner*—Scott L. Brown
*Attorney, Agent, or Firm*—Kirschstein, Kirschstein, Ottinger & Israel

[57] ABSTRACT

A trucking simulation game in which the players load their trucks and move over a playing path buying and selling goods at marked spaces along the path; chance cards determine the amount and price of the goods bought when a player's truck lands on a buy space and another set of cards determining amount and price of goods sold when a player lands on a sell space. The playing path is made up of spaces having differing instructions. Also included is a simulated weigh station, courthouse and vacation spaces. The winner is the player with the most money at the end of the path.

9 Claims, 1 Drawing Figure

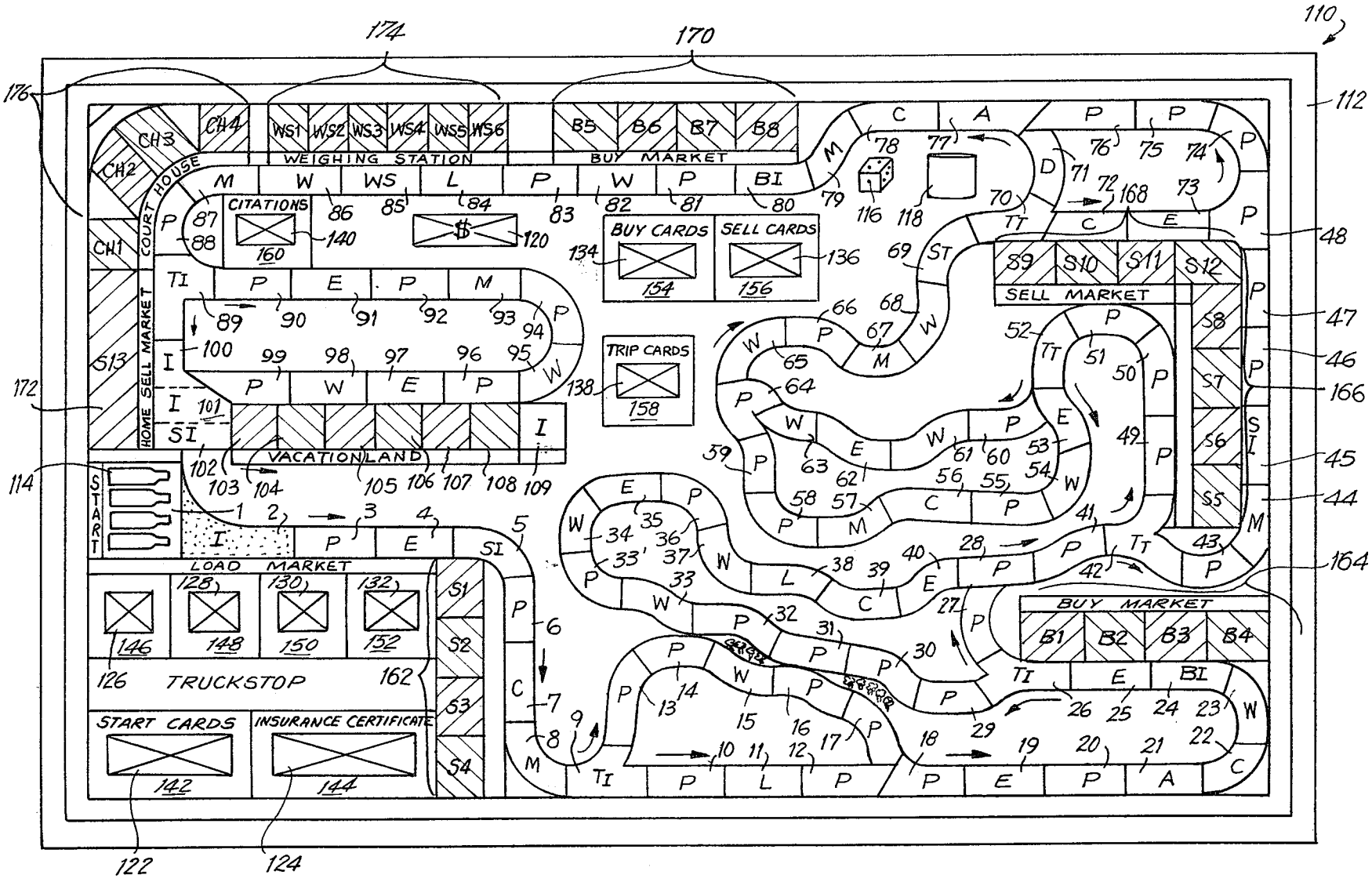
SELL MARKET
BUY MARKET
SELL CARDS
BUY CARDS
TRIP CARDS
WEIGHING STATION
CITATIONS
COURT HOUSE
HOME SELL MARKET
VACATION LAND
LOAD MARKET
TRUCKSTOP
INSURANCE CERTIFICATE
START CARDS
START

TRUCKING SIMULATION GAME

DISCLOSURE DOCUMENT INFORMATION

The subject matter of this patent application was previously accepted and preserved by the U.S. Patent and Trademark Office as Disclosure Document 083505 on Aug. 16, 1979.

BACKGROUND OF THE INVENTION

1. Field of the Invention

The present invention generally relates to board games and, more particularly, to a trucking simulation game for two or more players in which the real-life trucking environment of buying and selling goods at different quantities and prices along a travel route is simulated in a game situation.

2. Description of the Prior Art

Board games are of course well known. However, to my knowledge, a board game which simulates the trucking environment has not heretofore been proposed. In recent years the trucking industry has been well publicized in the media, particularly in the movies and on television, thereby increasing the overall popularity of the trucking industry. With the ever-increasing popularity of board games in general, a board game with a trucking theme is desirable not only in terms of entertainment reward, but also in terms of its educational value.

SUMMARY OF THE INVENTION

1. Objects of the Invention

Accordingly, it is the general object of the present invention to overcome the drawbacks of the prior art board games.

Another object of this invention is to reliably simulate a real-life trucking environment in a game situation.

Still another object of this invention is to provide a board game with a trucking theme which is rich in entertainment reward and educational value.

Yet another object of this invention is to simulate the transporting, buying and selling of goods along a travel route in a game situation.

2. Features of the Invention

In keeping with these objects and others which will become apparent hereinafter, one feature of the invention resides, and briefly stated, in a trucking simulation game, and method of playing the same, for two or more players, which comprises a truck-like playing piece for each player, and a playing board having a predetermined travel path which is constituted of a plurality of playing spaces along which each truck-like playing piece is advanced during play.

The game includes truck load means for simulating different goods to be considered loaded on each truck-like playing piece, and load instruction means for indicating to each player the quantities of each of the different goods to be considered loaded on the respective truck-like playing piece.

The game also includes buy means for simulating the buying by each player of a plurality of different goods to be considered loaded on the respective truck-like playing piece, and buy instruction means for indicating to each player, upon the arrival of his playing piece at a predetermined buying space of the travel path, of the quantities and prices of each of the different goods to be bought.

The game still further includes sell means for simulating the selling by each player of a plurality of different bought goods, and sell instruction means for indicating to each player, upon the arrival of his playing piece at a predetermined selling space of the travel path, of the quantities and prices of each of the different bought goods to be sold. The buy instruction means and the sell instruction means respectively indicate different quantities and different prices for each of the goods to be bought and sold.

The game yet further includes random chance means for indicating to each player the number of playing spaces that the player must advance his respective playing piece along the travel path during his turn.

Hence, in accordance with this invention, the real-life trucking environment of buying and selling different goods at different quantities and prices along a travel route is simulated in a game situation. This trucking stimulation game not only provides hours of entertainment for children, but is also rich in educational value because it teaches the child by first-hand experience of the mechanics of buying and selling goods in the trucking environment.

In further accordance with this invention, a weighing station is simulated on the playing board, and is operative for advising each player in response to the random chance means of the extent to which his respective truck-like playing piece is overloaded with goods. Furthermore, a court house is simulated on the playing board for advising each player in response to the number and type of traffic citations received during playing the game of the fine which the respective player pays. Still another feature of the game is a vacation simulation means on the playing board which is operative for advising each player in response to the random chance means of the amount due for each player to pay for the cost of his vacation. Hence, all of the aforementioned simulation features cooperate to teach the child in a game situation of the uncertain nature and aspects of the trucking environment.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a top plan view of a trucking simulation game in accordance with this invention.

DETAILED DESCRIPTION OF THE PREFERRED EMBODIMENT

Referring now to the single FIGURE again, reference number 110 generally identifies a trucking simulation game which can be played in accordance with this invention by two or more players. The game 110 comprises a playing board 112, which is preferably foldable along a center line and constituted of a cardboard-type material, and a plurality of playing pieces 114, each of which is preferably shaped as a miniature truck to conform to the trucking theme of this game. The upper surface of the board 112 is imprinted with a maze-like travel path which is constituted of a plurality of playing spaces along which each truck-like playing piece is advanced during play. Prior to play, each playing piece 114 is placed on the start space 1, and thereupon, the playing pieces are advanced along various of the playing spaces 2–109 of the travel path in accordance with the method of playing the game, as described below.

A random chance means, such as a die 116 and a cup-shaped dispenser 118, are used to indicate to each player the number of playing spaces that his playing piece must advance along the travel path during his turn.

The game also includes play money 120 which are preferably provided in the following denominations and quantities:

$500 (30 each); $1,000 (40 each); $5,000 (40 each); $10,000 (50 each); $20,000 (50 each); $50,000 (50 each); $100,000 (50 each); and $500,000 (30 each).

The game also includes various game cards which are vertically stacked on the playing board 112 at different predetermined locations thereon. As described in greater detail below, the start cards 122; the insurance certificate cards 124; the goods receipt cards 126, 128, 130, 132; the buy instruction cards 134; the sell instruction cards 136; the trip cards 138; and the traffic citation cards 140 are stacked at board locations 142, 144, 146, 148, 150, 152, 154, 156, 158 and 160, respectively. The game cards are preferably provided in the following quantities: start cards (12 each); insurance certificate cards (8 each); goods receipt cards (50 for each type); buy cards (12 each); sell cards (12 each); trip cards (12 each); and traffic citation cards (24 each).

A simulated buy market and a simulated sell market are also located on the playing board at different predetermined locations thereon. For example, a sell market 162 which includes areas S1, S2, S3, S4 is located on the board adjacent playing spaces 5–8. A buy market 164 which includes areas B1, B2, B3, B4 is located on the board adjacent playing spaces 23–26. Another sell market 166 which includes areas S5, S6, S7, S8 is located on the board adjacent playing spaces 44–47. Still another sell market 168 which includes areas S9, S10, S11, S12 is located on the board adjacent playing spaces 70–73. Another buy market 170 which includes areas B5, B6, B7, B8 is located on the board adjacent playing spaces 80–83. Still another sell market 172 which includes area S13 is located on the board adjacent playing spaces 100–102.

A simulated weigh station 174 which includes areas WS1, WS2, WS3, WS4, WS5 and WS6 is located on the board adjacent playing spaces 84–86. A simulated court house 176 which includes areas CH1, CH2, CH3, CH4 is located on the playing board adjacent playing spaces 87–89.

As noted above, the travel path has a plurality of playing spaces 2–109. The stippling in space 2 is intended to designate that this space contains information thereon to advise the players accordingly. It will be understood that all of the playing spaces 2–109 contain such player information therein, but that the stippling has not been illustrated in spaces 2–109 for the sake of simplifying the drawing. The following table sets forth the information which is contained in each space for a preferred embodiment of this game:

| SPACE | DESCRIPTION |
|---|---|
| 2 | TAKE A START CARD AND LOAD YOUR TRUCK BUY INSURANCE CERTIFICATE |
| 3 | FILL UP YOUR TRUCK WITH FUEL PAY $15,000.00 |

-continued

| SPACE | DESCRIPTION |
|---|---|
| 4 | COLLECT EXPENSE ALLOWANCE |
| 5 | TAKE A SELL CARD AND FOLLOW INSTRUCTIONS |
| 6 | MAKE MORTGAGE PAYMENT $25,000.00 |
| 7 | RECEIVE A CITATION |
| 8 | COLLECT $50,000.00 SALARY |
| 9 | TAKE A TRIP CARD AND FOLLOW INSTRUCTIONS |
| 10 | TIRE REPAIR - PAY $1,000.00 |
| 11 | DETOUR LOSE A TURN |
| 12 | DAMAGE A FENCE - PAY $1,000.00 |
| 13 | SEND HOME ALLOWANCE - PAY $35,000.00 |
| 14 | BUY A COLOR T.V. - PAY $2,000.00 |
| 15 | STOP AND HELP A DISABLED MOTORIST COLLECT $5,000.00 |
| 16 | BUY TOYS FOR CHILDREN - PAY $500.00 |
| 17 | BUY A SPEEDBOAT - PAY $1,000.00 |
| 18 | PAY TOLL $1,000.00 |
| 19 | COLLECT EXPENSE ALLOWANCE |
| 20 | SCHOOL TUITION SEND $25,000.00 HOME |
| 21 | ACCIDENT!!! SELL ENTIRE LOAD AT $500.00 PER CASE - RELOAD TRUCK AS PER INSTRUCTIONS |
| 22 | RECEIVE A CITATION |
| 23 | STOP AT HIALEAH RACEWAY - WIN $250,000.00 |
| 24 | TAKE A BUY CARD AND FOLLOW INSTRUCTIONS |
| 25 | COLLECT EXPENSE ALLOWANCE |
| 26 | TAKE A TRIP CARD AND FOLLOW INSTRUCTIONS |
| 27 | FUEL FILL UP - PAY $30,000.00 |
| 28 | MAKE MORTGAGE PAYMENT - PAY $30,000.00 |
| 29 | HAVE ADDITION PUT ON HOME - PAY $50,000.00 |
| 30 | CONTRIBUTE $1,000.00 TO FAVORITE CHARITY |
| 31 | BUY ANNIVERSARY GIFT FOR WIFE - PAY $10,000.00 |
| 32 | DAMAGE TRUCK AT LOW OVERPASS - PAY $20,000.00 FOR REPAIR |
| 33 | WIN LOTTERY-COLLECT $150,000.00 |
| 33′ | STOP AT MOTEL - PAY $500.00 |
| 34 | HELP A FELLOW TRUCKER - COLLECT $5,000.00 |
| 35 | COLLECT EXPENSE ALLOWANCE |
| 36 | FUEL FILL UP - PAY $10,000.00 |
| 37 | SAFE DRIVER AWARD - COLLECT $10,000.00 |
| 38 | PULL OVER - FALL ASLEEP LOSE ONE TURN |
| 39 | RECEIVE A CITATION |
| 40 | COLLECT EXPENSE ALLOWANCE |
| 41 | PAY TOLL $1,000.00 |
| 42 | TAKE A TRIP CARD AND FOLLOW INSTRUCTIONS |
| 43 | STOP AT MOTEL - PAY $500.00 |
| 44 | COLLECT $50,000.00 SALARY |
| 45 | TAKE A SELL CARD AND FOLLOW INSTRUCTIONS |
| 46 | TIRE REPAIR - PAY $1,500.00 |
| 47 | SEND HOME ALLOWANCE - PAY $35,000.00 |
| 48 | BUY A CUSTOM MADE VAN - PAY $20,000.00 |
| 49 | HIGHWAY TAXES - PAY $5,000.00 |
| 50 | BUY A NEW CAR - PAY $20,000.00 |
| 51 | BUY TWO NEW MOTORCYCLES - PAY $30,000.00 |
| 52 | TAKE A TRIP CARD AND FOLLOW INSTRUCTIONS |
| 53 | COLLECT EXPENSE ALLOWANCE |
| 54 | HELP A FELLOW TRUCKER - COLLECT $25,000.00 |
| 55 | TIRE REPAIR - PAY $1,500.00 |
| 56 | RECEIVE A CITATION |
| 57 | COLLECT $50,000.00 SALARY |
| 58 | HAVE MOTOR REPAIRED - PAY $15,000.00 |
| 59 | STOP OVER AT MOTEL - PAY $500.00 |
| 60 | FUEL FILL UP - PAY $25,000.00 |
| 61 | HELP A DISABLED MOTORIST - COLLECT $5,000.00 |
| 62 | COLLECT EXPENSE ALLOWANCE |
| 63 | SAFE DRIVER AWARD - COLLECT $10,000.00 |
| 64 | MEDICAL BILLS FOR NEW BABY - PAY $25,000.00 |
| 65 | RETURN STRAY ANIMAL - COLLECT $500.00 REWARD |
| 66 | FUEL FILL UP - PAY $30,000.00 |
| 67 | COLLECT $50,000.00 SALARY |
| 68 | HELP A DISABLED MOTORIST - COLLECT |

-continued

| SPACE | DESCRIPTION |
|---|---|
| | $1,000.00 |
| 69 | TAKE A SELL CARD AND FOLLOW INSTRUCTIONS |
| 70 | TAKE A TRIP CARD AND FOLLOW INSTRUCTIONS |
| 71 | DETOUR TAKE OTHER ROUTE |
| 72 | RECEIVE A CITATION |
| 73 | COLLECT EXPENSE ALLOWANCE |
| 74 | STOP OVER AT MOTEL - PAY $500.00 |
| 75 | PAY TOLL $1,500.00 |
| 76 | FUEL FILL UP - PAY $25,000.00 |
| 77 | ACCIDENT!!! SELL ENTIRE LOAD AT $500.00 PER CASE - RELOAD TRUCK AS PER INSTRUCTIONS |
| 78 | RECEIVE A CITATION |
| 79 | COLLECT $50,000.00 SALARY |
| 80 | TAKE A BUY CARD AND FOLLOW INSTRUCTIONS |
| 81 | SEND $2,000.00 HOME |
| 82 | SAFE DRIVER AWARD - COLLECT $250,000.00 IF NO ACCIDENTS |
| 83 | HIGHWAY TAXES - PAY $1,500.00 |
| 84 | RECKLESS DRIVING - LOSE INSURANCE |
| 85 | WEIGH STATION - ROLL DIE FOR WEIGHING LOCATION AND PAY AMOUNT INDICATED |
| 86 | IF YOU JUST ROLLED A 2 COLLECT $1,000.00 |
| 87 | COLLECT $50,000.00 SALARY |
| 88 | PAY $3,500.00 TOLL AND ANY CITATIONS |
| 89 | TAKE A TRIP CARD AND FOLLOW INSTRUCTIONS |
| 90 | STOP OVER AT MOTEL - PAY $1,000.00 |
| 91 | COLLECT EXPENSE ALLOWANCE |
| 92 | BUY A RACE HORSE - PAY $50,000.00 |
| 93 | COLLECT $50,000.00 SALARY |
| 94 | SEND HOME ALLOWANCE - PAY $35,000.00 |
| 95 | STOP AT BELMONT RACEWAY - WIN $200,000.00 |
| 96 | TIRE REPAIR - PAY $2,000.00 |
| 97 | COLLECT EXPENSE ALLOWANCE |
| 98 | SAFE DRIVER AWARD - COLLECT $50,000 IF NO ACCIDENTS |
| 99 | IF NOT INSURED - PAY $50,000.00 |
| 100 | EACH PLAYER COLLECT BONUS OF $350,000.00 |
| 101 | FIRST PLAYER TO ARRIVE - COLLECT $50,000.00 FROM EACH PLAYER |
| 102 | SELL ENTIRE LOAD TO HOME MARKET AND ROLL DIE. VACATION AT CORRESPONDING NUMBER |
| 103 | GO TO FLORIDA - PAY $450,000.00 |
| 104 | GO TO THE BAHAMAS - PAY $600,000.00 |
| 105 | GO TO SWITZERLAND - PAY $500,000.00 |
| 106 | GO TO NEW YORK CITY - PAY $800,000.00 |
| 107 | TAKE AN AFRICAN SAFARI - PAY $950,000.00 |
| 108 | TAKE A WORLD CRUISE - PAY $850,000 |
| 109 | BANKRUPT - TRY AGAIN |

As for the buy and sell markets, the following table sets forth the information which is contained in each area of the markets:

| AREA | DESCRIPTION |
|---|---|
| S-1 | ORANGES - SELL FOR $25,000.00 PER CASE |
| S-2 | PEACHES - SELL FOR $45,000.00 PER CASE |
| S-3 | POTATOES - SELL FOR $15,000.00 PER CASE |
| S-4 | CORN - SELLS FOR $20,000.00 PER CASE |
| S-5 | ORANGES - SELL FOR $35,000.00 PER CASE |
| S-6 | PEACHES - SELL FOR $55,000.00 PER CASE |
| S-7 | POTATOES - SELL FOR $25,000.00 PER CASE |
| S-8 | CORN - SELLS FOR $30,000.00 PER CASE |
| S-9 | ORANGES - SELL FOR $35,000.00 PER CASE |
| S-10 | PEACHES - SELL FOR $55,000.00 PER CASE |
| S-11 | POTATOES - SELL FOR $25,000.00 PER CASE |
| S-12 | CORN - SELLS FOR $30,000 PER CASE |
| S-13 | LAST STOP - UNLOAD TRUCK - RECEIVE PAYMENT |
| | SELL ORANGES AT $100,000.00 PER CASE |
| | SELL PEACHES AT $100,000.00 PER CASE |
| | SELL POTATOES AT $50,000.00 PER CASE |

-continued

| AREA | DESCRIPTION |
|---|---|
| | SELL CORN AT $50,000.00 PER CASE |
| B-1 | ORANGES COST $20,000.00 PER CASE |
| B-2 | PEACHES COST $40,000.00 PER CASE |
| B-3 | POTATOES COST $10,000.00 PER CASE |
| B-4 | CORN COSTS $15,000.00 PER CASE |
| B-5 | ORANGES COST $40,000.00 PER CASE |
| B-6 | PEACHES COST $60,000.00 PER CASE |
| B-7 | POTATOES COST $20,000.00 PER CASE |
| B-8 | CORN COSTS $30,000.00 PER CASE |

As for the weighing station 174, the following table sets forth the information which is contained in each area thereof:

| AREA | DESCRIPTION |
|---|---|
| WS1 | LIMIT 12 CASES - IF OVER PAY $25,000.00 PER CASE |
| WS2 | LIMIT 9 CASES - IF OVER PAY $12,000.00 PER CASE |
| WS3 | LIMIT 10 CASES - IF OVER PAY $15,000.00 PER CASE |
| WS4 | LIMIT 8 CASES - IF OVER PAY $8,000.00 PER CASE |
| WS5 | LIMIT 11 CASES - IF OVER PAY $20,000.00 PER CASE |
| WS6 | LIMIT 7 CASES - IF OVER PAY $5,000.00 PER CASE |

As for the court house 176, the following table sets forth the information which is contained in each area thereof:

| AREA | | DESCRIPTION |
|---|---|---|
| CH1 | SPEEDING | 1 TICKET = PAY $25,000.00 |
| | | 2 TICKETS = PAY $50,000.00 |
| | | 3 TICKETS = PAY $100,000.00 |
| CH2 | RED LIGHT | 1 TICKET = PAY $15,000.00 |
| | | 2 TICKETS = PAY $30,000.00 |
| | | 3 TICKETS = PAY $60,000.00 |
| CH3 | STOP SIGN | 1 TICKET = PAY $10,000.00 |
| | | 2 TICKETS = PAY $20,000.00 |
| | | 3 TICKETS = PAY $40,000.00 |
| CH4 | ILLEGAL TURN | 1 TICKET = PAY $10,000.00 |
| | | 2 TICKETS = PAY $20,000.00 |
| | | 3 TICKETS = PAY $40,000.00 |

As for the predetermined locations on the board on which stacks of cards are to be mounted, the following table sets forth the information which is contained in each of the predetermined locations:

| AREA | DESCRIPTION |
|---|---|
| 142 | START CARDS |
| 144 | INSURANCE CERTIFICATES |
| 146 | PLACE ORANGE RECEIPTS HERE |
| 148 | PLACE PEACH RECEIPTS HERE |
| 150 | PLACE POTATO RECEIPTS HERE |
| 152 | PLACE CORN RECEIPTS HERE |
| 154 | PLACE BUY CARDS HERE |
| 156 | PLACE SELL CARDS HERE |
| 158 | PLACE TRIP CARDS HERE |
| 160 | CITATIONS |

Referring again to the travel path, it will be noted that the playing spaces marked with the letter P denote penalty spaces, e.g., spaces 3, 6, 10, 20, in each of which a money penalty is assessed against the player whose playing piece lands on the penalty space at the conclusion of his turn. The playing spaces marked with the letter W denote win spaces, e.g., spaces 15, 23, 68, in each of which the player collects money when his playing piece lands thereon. The playing spaces marked with the letter E denote expense allowance spaces, e.g., spaces 4, 19, 25, in each of which an expense allowance is collected when the respective playing piece lands on, or passes, the expense allowance space. The playing spaces marked with the letter C denote traffic citation spaces, e.g., spaces 7, 22, 39, in each of which the player is compelled to draw a traffic citation card from stack 140 when his playing piece lands on each citation space. The playing spaces marked with the letter I denote information spaces, e.g., spaces 1, 100, 101, in each of which the player is provided with instructions for playing the game. The playing spaces marked with the letter M denote money or salary spaces, e.g., spaces 8, 57, 93, in each of which the player collects his salary. The playing spaces marked with the letter L denote loss spaces, e.g., spaces 11, 84, in each of which the player loses something of a non-financial nature. The playing spaces marked with the letter A denote accident spaces, e.g., spaces 21, 87, in each of which the player follows the accident instructions set forth in the accident spaces.

Each sell market 162, 166, 168, 172 has sell instruction spaces 5, 45, 69, 102 respectively associated therewith, each sell instruction space being marked with the letters SI. Each buy market 164, 170 has buy instruction spaces 24, 80 respectively associated therewith, each buy instruction space being marked with the letters BI. As described below, when a playing piece lands on, or passes, a BI space or an SI space, the player selects the topmost card from the buy card stack 134, or the sell card stack 136, respectively, and follows the buying and selling instructions listed thereon.

The travel path also includes trip instruction spaces which have been marked with the letters TI, e.g., trip instruction spaces 9, 26, 42, 52, 70, 89. At each TI space the travel path has a bypass pathway or detour which branches off, and thereupon, returns to the main path. For example, the playing spaces 13–17 constitute a bypass pathway with respect to the main travel path which constitutes spaces 10–12. As described below, when a piece lands on, or passes, a TI space during his turn, the player selects the topmost card from the trip card stack 138, and follows the instructions thereon, i.e. to proceed towards the right along the main path, or to proceed towards the left along the bypass pathway.

The method of playing the game is as follows: one player should be designated as a banker, and another as a market manager. The banker handles all financial transactions involving the money 120, while the market manager is in charge of the goods receipt cards 126, 128, 130, 132. The banker initially distributes $200,000 to each player in the following denominations and quantities: $100,000 (one); $50,000 (one); $20,000 (one); $10,000 (one); $5,000 (three); $1,000 (three); $500 (four). The market manager shuffles the card stacks 122, 124, 134, 136, 138, 140, and places them on the aforementioned respective predetermined areas on the board. The goods receipt cards are of four types, e.g., orange receipt cards 126, peach receipt cards 128, potato receipt cards 130, and corn receipt cards 132, which are respectively placed on the playing board at predetermined locations 146, 148, 150, 152, respectively. Of course, the particular goods mentioned are purely exemplary, and any other goods could have been chosen.

Each player then chooses a differently colored truck-like playing piece 114, and places the same on the start space 1. To begin play, each player draws a start card 122 which lists thereon the quantities and prices for each of the goods to be considered loaded on the playing piece. Hence, the start cards constitute a load instruction means for indicating the quantities and prices of the goods. Each player purchases the amount of goods listed on the start card, pays the banker for the same, and receives the proper amount of receipt cards from the market manager. Each truck is now considered to be loaded with the merchandise. Each start card also advises the player what his expense allowance will be during the trip. Thereupon, each player purchases an insurance card from stack 124 for $10,000.

Each player then shakes the die 116 in the cup 118, and the highest number goes first. The play continues in a clockwise direction. There is to be no unauthorized exchange of money or goods between players. During each turn, the players advance their pieces the number of spaces indicated on the die. If a playing piece lands on an occupied space, it has to move to the next space.

If a piece lands on a penalty space, then the player must pay the indicated penalty to the banker. If a piece lands on, or passes, a P space market as a toll, e.g., toll spaces 18, 41, 75, then the player must pay the indicated toll. If a piece lands on a W space, then the player must collect the indicated amount from the banker. If a piece lands on, or passes, an E space or an M space, then the player must collect the appropriate amount of money from the banker. If a piece lands on, or passes, a BI, SI, or TI space, then the player must select the topmost card from the buy stack 134, sell stack 136, and trip stack 138, respectively, and follow the instructions thereon.

An insurance certificate 124 is purchased by each player at the beginning of the game, and these certificates are to be held unless a piece lands on a "lose insurance" space. In that case, the player turns in his insurance certificate. If the player does not lose his insurance certificate during play, then he collects $50,000 at the end of the game.

Upon reaching each sell instruction space, e.g., space 5, the player selects the topmost sell card 136 which instructs him how much merchandise to sell, e.g., how many cases of each of the goods to sell. The sell market 162 constitutes a sell means for simulating the selling of merchandise, and the sell cards 136 constitute a sell instruction means for indicating to each player the quantities of the different goods to be sold. If the player does not have the amount of merchandise shown on the sell card, then he may only sell as much as he has. The player may not substitute one type of goods for another. The prices for each of the goods is indicated directly on the game board areas S1, S2, S3, S4. Hence, this price information also constitutes part of the sell instruction means. The goods receipt cards are returned to the market manager after the sale is completed.

In an analagous manner, upon reaching each buy instruction space, e.g., space 24, the player selects the topmost buy card 134 which instructs him how much merchandise to buy, e.g., how many cases of each of the goods to buy. The buy market 164 constitutes a buy means for simulating the buying of merchandise, and the buy cards constitute a buy instruction means for indicating to each player the quantities of the different goods to be bought. If the player does not have enough money to buy the goods in the quantities indicated, then he buys as much as he can afford. The prices for each of the goods are indicated directly on the playing board at areas B1, B2, B3, B4. Hence, this price information also constitutes part of the buy instruction means. The money is paid directly to the banker.

If a player lands on an accident space, he has to sell his entire load back to the market manager for $500 per case, and thereupon proceed to the next buy instruction space, and reload his playing piece with the same amount listed on his start card. The player does not take a buy card; however, he must pay the amounts designated at the market that he has just advanced to for his new load. Purchases may not exceed the amount listed on the start card, but he may purchase less if he cannot afford to restock the entire load. The player does not collect any salary and expense money when he moves from the accident space to the next buy instruction space.

When the playing piece lands on, or passes, weigh station space 85, the player rolls the die. The number indicated on the die, i.e., 1 through 6, tells him the overload information contained in the areas WS1-WS6, respectively, which he must follow. The player must count the receipt cards currently on hand, and pay the amount listed on the area in question if he is over the limit. The playing piece is not moved on this roll of the die.

When the playing piece lands on, or passes, the court house 176, the player pays the amount indicated in areas CH1 through CH4 depending on how many and the types of citation cards that the player has previously received by landing on the citation spaces.

When each player reaches the home market 172, he has to sell all of his on-hand merchandise at the prices indicated in the area S13. Thereupon, each player collects the bonus money indicated in bonus spaces 100, 101. After each player has unloaded and sold his merchandise at the home market 172, each player rolls the die and takes a simulated vacation corresponding to the number on the die. Hence, the numbers 1 through 6 corresponds to the vacations and associated costs indicated on spaces 103 through 108, respectively.

If at any time during the course of the game, a player runs out of money, he may sell his on-hand merchandise back to the market manager for $5,000 per case. If a player sells all of his merchandise and still does not have enough money to cover his expenses, he is considered bankrupt, and turns in his truck and his insurance certificate, and proceeds to bankruptcy space 109. This automatically eliminates this player from the game. He is not entitled to any bonus money, nor does he collect on his insurance certificate. In accordance with the rules, a player may, by rolling large numbers, finish way ahead of the other players, in which case this player may take a double trip. In this case, after completion of his first trip, he has to turn in his original start card, draw a new start card, reload his truck and make a second trip before taking his vacation. He does not collect an additional $200,000 as he did at the beginning of the game, nor does he collect any bonus monies from the bonus spaces 100, 101. He is to hold on to his insurance cards, citation cards, and buy new merchandise as is listed on his new start card. If a player loses his insurance on his first trip, then he has to purchase a new one on his second trip. No player may own more than one insurance card at a time. If a player makes a double trip, then he does not pay any citations at the court house until the second time around.

At the end of the game, after each player has sold his load at the home market and received payments therefor, sold his insurance certificate (if applicable), collected his bonus money, and paid for his vacation, then he counts his money. The richest player wins the game.

It will be understood that each of the elements described above, or two or more together, may also find a useful application in other types of constructions differing from the types described above.

The game may also include a hand-held calculator to assist in the calculations of the monies to be paid to the bank or to the other players.

While the invention has been illustrated and described as embodied in a trucking simulation game and method of playing the same, it is not to be limited to the details shown, since various modifications and structural changes may be made without departing in any way from the spirit of the present invention.

Without further analysis, the foregoing will so fully reveal the gist of the present invention that others can by applying current knowledge readily adopt it for various applications without omitting features that, from the standpoint of prior art, fairly constitute essential characteristics of the generic or specific aspects of this invention and, therefore, such adaptations should and are intended to be comprehended within the meaning and range of equivalence of the foregoing claims.

What is claimed as new and desired to be protected by Letters Patent is set forth in the appended claims:

1. A trucking simulation game for simulating a real-life trucking environment for two or more players, comprising:

(a) a truck-like playing piece for each player;

(b) a playing board having a predetermined travel path which is constituted of a plurality of playing spaces along which each truck-like playing piece is advanced during play;

(c) truck load cards including a plurality of stacks of receipt cards for simulating different goods to be considered loaded on each truck-like playing piece, each receipt stack corresponding to a different goods and being stackable at a predetermined location on the playing board;

(d) load instruction cards including a stack of start cards for indicating to each player the quantities of each of the different goods to be considered loaded on the respective truck-like playing piece, said stack of start cards being stackable at a different predetermined location on the playing board, and indicating to each player who selects a card from the start stack of the quantities and prices of the different goods;

(e) simulated buy markets for simulating the buying by each player of a plurality of different goods to be considered loaded on the respective truck-like playing piece, each buy market being located at a different predetermined location of the playing board, each buy market composed of a plurality of buy areas each containing information of the prices of each of the goods to be bought;

(f) buy instruction cards including a stack of buy cards for indicating to each player, upon the arrival of his playing piece at a predetermined buying space of the travel path, of the quantities of each of the different goods to be bought, said stack of buy cards being stackable at a different predetermined location on the playing board, and indicating to each player who selects a buy card upon the arrival of a playing piece at the predetermined buying space of the quantities of each of the goods to be bought;

(g) simulated sell markets for simulating the selling by each player of a plurality of different bought goods, each sell market being located at a different predetermined location on the playing board, at least some of the sell markets being composed of a plurality of sell areas each containing information of the prices of each of the goods to be sold;

(h) sell instruction cards including a stack of sell cards for indicating to each player, upon the arrival of his playing piece at a predetermined selling space of the travel path, of the quantities of each of the different bought goods to be sold, said stack of sell cards being stackable at a different predetermined location on the playing board, and indicating to each player who selects a sell card upon the arrival of a playing piece at the predetermined selling space of the quantities of each of the goods to be sold;

(i) said buy instruction cards, said buy markets, said sell instruction cards and said sell markets indicating respective different quantities and different prices for each of the goods to be bought and sold;

(j) random chance means for indicating to each player the number of playing spaces that each player must advance his respective playing piece along the travel path during his turn, whereby the real-life trucking environment of loading, unloading, buying and selling different goods at different quantities and prices along a trucking route is simulated in a game situation.

2. The game as defined in claim 1, wherein the travel path has a plurality of trip spaces and bypass pathways; and further comprising a stack of trip instruction cards for indicating to each player, upon the arrival of his playing piece at each trip space of the travel path, whether to advance along the respective bypass pathway; and wherein said trip instruction cards are stackable at a different predetermined location on the playing board.

3. The game as defined in claim 1, wherein the travel path has a plurality of penalty spaces for indicating to a player whose playing piece arrives thereat that a payment is owed by him, a plurality of win spaces for indicating to a player whose playing piece arrives thereat that a payment is owing to him, a plurality of expense allowance spaces for indicating to a player whose playing piece passes each of said expense allowance spaces that an expense allowance payment is due him, and a plurality of salary spaces for indicating to a player whose playing piece passes each of said salary spaces that a salary payment is due him.

4. The game as defined in claim 1, wherein the travel path has a plurality of traffic citation spaces; and further comprising a stack of citation instruction cards for indicating to each player whose playing piece arrives at a traffic citation space the nature of the traffic citation, said citation instruction cards being stackable at a different predetermined location on the playing board.

5. The game as defined in claim 4; and further comprising a court house simulation area on the playing board, for advising each player in response to the number and type of traffic citations of the fine which the respective player pays.

6. The game as defined in claim 1, wherein the travel path has a plurality of traffic accident spaces for indicating to a player whose playing piece arrives thereat that a traffic accident has occurred.

7. The game as defined in claim 1; and further comprising insurance cards stackable at a different predetermined location on the playing board.

8. The game as defined in claim 1; and further comprising a simulated weigh station including a plurality of overload areas located on the playing board, for advising each player in response to the number indicated by the random chance means of the overload area that indicates the extent to which his respective truck-like playing piece is overloaded with goods.

9. The game as defined in claim 1; and further comprising a vacation simulator including a plurality of vacation areas located on the playing board, for advising each player in response to the number indicated by the random chance means of the vacation area that indicates the amount due to pay for the cost of a vacation for the respective player.

* * * * *